US007387820B2

(12) United States Patent
Nikkanen et al.

(10) Patent No.: US 7,387,820 B2
(45) Date of Patent: Jun. 17, 2008

(54) EQUIPMENT AND METHOD FOR CHANGING A BLADE IN A COATING DEVICE

(75) Inventors: Ville Nikkanen, Helsinki (FI); Seppo Parviainen, Jyväskylä (FI); Markku Vaanola, Varkaus (FI)

(73) Assignee: Metso Paper, Inc., Helsinki (FI)

( * ) Notice: Subject to any disclaimer, the term of this patent is extended or adjusted under 35 U.S.C. 154(b) by 216 days.

(21) Appl. No.: 10/547,124

(22) PCT Filed: Feb. 19, 2004

(86) PCT No.: PCT/FI2004/050018

§ 371 (c)(1),
(2), (4) Date: Sep. 14, 2005

(87) PCT Pub. No.: WO2004/081283

PCT Pub. Date: Sep. 23, 2004

(65) Prior Publication Data

US 2006/0117541 A1 Jun. 8, 2006

(30) Foreign Application Priority Data

Feb. 27, 2003 (FI) ..... 20035024

(51) Int. Cl.
*B05D 1/40* (2006.01)
*B05C 1/14* (2006.01)

(52) U.S. Cl. ..... 427/356; 118/106; 118/126; 118/257; 118/413

(58) Field of Classification Search ..... 118/106, 118/123, 126, 257, 413; 162/281; 427/356; 15/256.5, 256.53; 100/174; 101/157, 169, 101/365

See application file for complete search history.

(56) References Cited

U.S. PATENT DOCUMENTS

| | | | | |
|---|---|---|---|---|
| 3,529,305 | A | 9/1970 | Dunlap et al. | |
| 4,802,928 | A * | 2/1989 | Dunlap | 134/15 |
| 4,895,071 | A | 1/1990 | Benton | |
| 5,138,740 | A | 8/1992 | Goodnow et al. | |
| 5,536,312 | A | 7/1996 | Madrzak et al. | |
| 5,782,976 | A | 7/1998 | Marziale et al. | |
| 5,974,966 | A | 11/1999 | Bruni | |
| 6,651,303 | B1 | 11/2003 | Toivanen et al. | |

FOREIGN PATENT DOCUMENTS

| | | | |
|---|---|---|---|
| FI | 103596 | B | 7/1999 |
| WO | WO 99/60207 | A1 | 11/1999 |
| WO | WO 02/099189 | A1 | 12/2002 |
| WO | WO 2004/081263 | A1 | 9/2004 |

* cited by examiner

*Primary Examiner*—Laura Edwards
(74) *Attorney, Agent, or Firm*—Stiennon & Stiennon

(57) ABSTRACT

Equipment for changing a blade (43) in a coating device (51) changes several blades (43) arranged in a band (43). The equipment includes reels (11, 40) connected to the ends of the blade holder (45), for holding the reeled unused and used band (43); transfer devices (13, 20) for moving the band (43) in connection with the blade holder (45), and lifting devices (17) for lifting the band (43) up and lowering it into the blade holder (45). Indentations (44) at least the length of the hollow shaft (52) are arranged at regular intervals on the band (43), and are arranged to permit the blade (43) to be lowered into the blade holder (45).

9 Claims, 5 Drawing Sheets

EQUIPMENT AND METHOD FOR CHANGING A BLADE IN A COATING DEVICE

CROSS REFERENCES TO RELATED APPLICATIONS

This application is a U.S. national stage application of international app. No. PCT/FI2004/050018, filed Feb. 19, 2004, the disclosure of which is incorporated by reference herein, and claims priority on Finnish Application No. 20035024, filed Feb. 27, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for changing a blade in a coating device, in which the blade is intended to be used in connection with coating, in a blade holder fitted to a blade beam, and in which the blade is formed as an elongated flexible band, the coating device including a blade-beam suspension arranged in connection with the frame at the ends of the blade beam, and which is arranged in a hollow shaft fitted to the frame, in such a way that, in the running position, the central axis of the hollow shaft is arranged to lie essentially on the edge line of the blade, and control equipment, arranged in connection with the blade-beam suspension, for adjusting the blade angle during running.

The invention also relates to a method for changing a blade in a coating device and a blade for use in a coating device.

Blades intended for coating are used in on-line coating stations in connection with paper and board machines, and in so-called off-line coating devices, which in terms of production are separate from the actual paper machine. Both of these will be referred to in the following by the general term coating device. In blade coating, the blade is used to regulate, among other things, the amount of coating remaining on the paper and to smooth the coated surface.

In coating, the blade wears in a very short time, causing it to lose the properties required for a successful coating result. Due to this, the blade must be changed for a new one on average at intervals of 4 to 8 hours running time. In addition, the blade is changed, for example, during web breaks and shutdowns, whether it is worn or not. Traditionally, blades in coating devices have been changed manually by the operators. However, it is difficult and even dangerous to change long blades. In addition, the regular changing of blades takes up a great deal of useful production time, leading to production losses. Further, during blade changing, uncoated broke is created, especially in situations in which coating takes place as an on-line operation in connection with the paper machine. In that case, the paper machine is run at the running speed set for it, even while the blade is being changed. Besides reducing effective production time, blade changes also tie up labor.

Finnish patent number 103596 discloses a changing equipment for a doctor blade. In the equipment, a band-like blade is fed to a blade holder from a reel and is then pulled from the blade holder onto a second reel. During changing, a band containing several blades can then be simply fed with the aid of operating devices.

However, in known types of coating devices, structural factors make the equipment described above unsuitable for changing coating blades. In a coating device, the blade holder is, as is known, arranged in a blade beam, the width of which corresponds at least to that of the backing roll. In the coating situation, the blade is loaded against the backing roll, the paper web, to which coating paste has been applied, running between the edge line of the blade and the backing roll. The blade beam is suspended on bearings from both sides of the coating device, in a so-called rotating frame. There is an opening in the upper part of the frames, in which there is a hollow shaft that acts as the bearing point for the blade beam. During running, the blade angle is adjusted by rotating the blade beam.

When the blade is changed, it can be brought into contact with the opened blade holder, for example, through the hollow shaft. The imaginary center-line of the hollow shaft in the running position is essentially at the line of the edge of the blade. This means that the lower edge of the gap formed by the locking jaws of the blade holder, against which the side of the blade opposite to the edge line is set when the blade is in the holder, is radially outside an imagined extension of the hollow shaft. Due to this, among other factors, known types of blade-changing equipment are in no way suitable for use in coating devices.

In addition, it would also be difficult to feed the band using known types of equipment, as in reality there is generally little installation space in connection with coating devices. Thus the reels would have to be located far from the coating device, in which case the band would have to be guided using complicated guide devices.

SUMMARY OF THE INVENTION

The present invention is intended to create equipment for changing the blade in a coating device, which equipment has a simple and operationally reliable construction and by means of which blade changing can even be carried out entirely automatically. The invention is also intended to create a method for blade changing in a coating device and a blade band for use in a coating device.

The use of the equipment and blade band according to the invention solves many of the problems caused by the structural factors of the coating device. This is achieved through simple shaping arranged in the blade and by the movement of the blade band carried out using the equipment. The equipment has a clear and reliable construction and preferably comprises only a few operating components.

The equipment according to the invention can be applied to different kinds of coating stations and different kinds of blades and blade holders. In the method according to the invention, shaping arranged in the blade holder is also used, so that the blade band can be brought to the blade holder and set in place rapidly and certainly. The use of the method achieves faster blade changes than previously, these being performed advantageously, without long interruptions in the coating process and even entirely without any work being required by the machine operation personnel.

According to yet another preferred embodiment, the changing of the blade-band reels can be arranged to take place smoothly using jointing devices arranged in connection with the equipment. Problems will then not arise, for example, even from the jointing seam formed between the end of the old band and the start of the new band.

In the following, the invention is examined in detail with reference to the accompanying drawings, which show some embodiments

DESCRIPTION OF THE PREFERRED EMBODIMENTS

Figure 1:
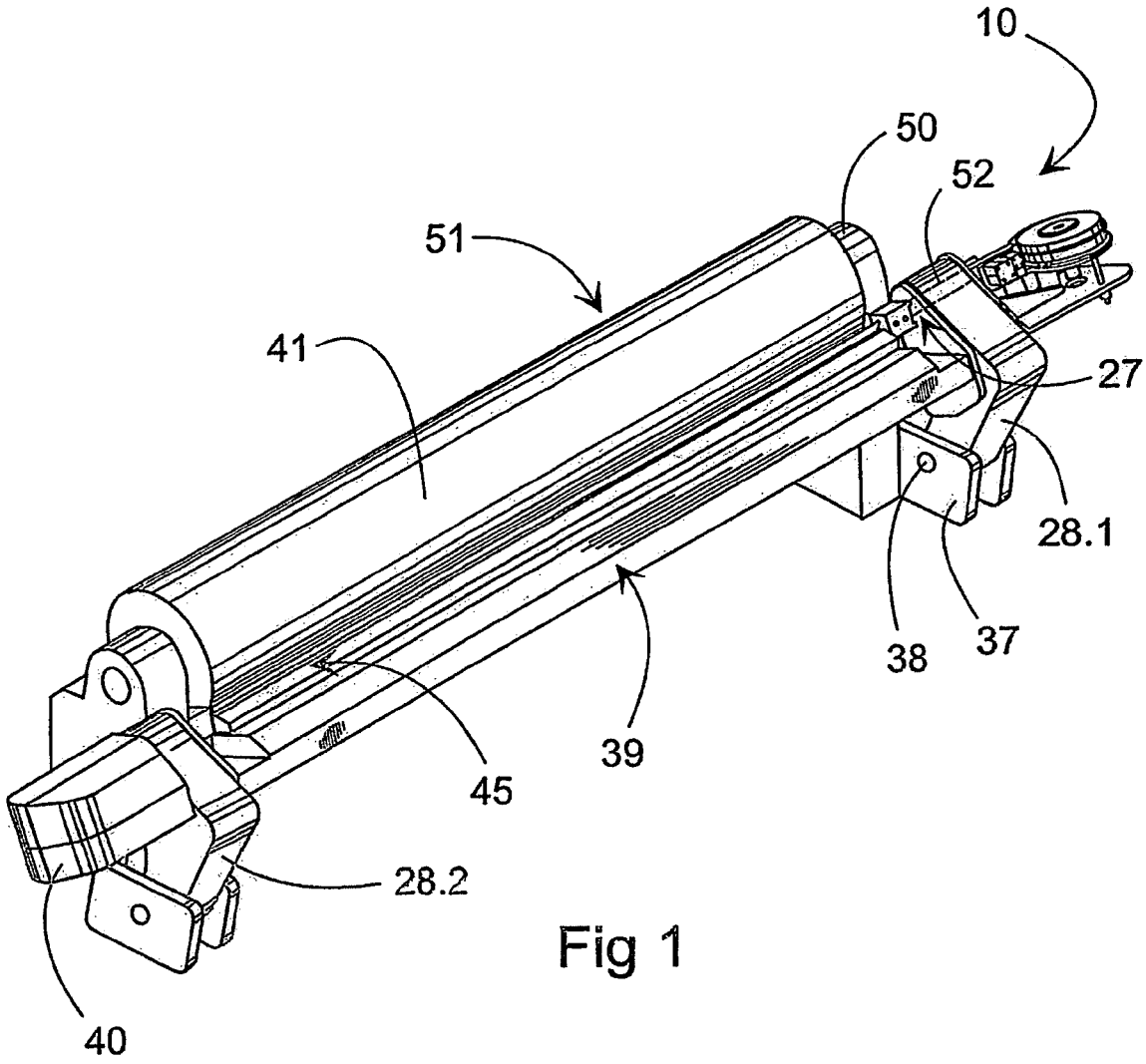
FIG. 1 is an axonometric view of a rough diagram of a coating device and the position in it of the equipment according to the invention.

FIG. 1 shows a rough diagram of the coating device 51 and the location of the equipment 10, 40 according to the invention, in connection with it. It should be noted that FIG. 1 shows only those parts of the coating device 51 that are essential from the point of view of the invention. The coating device 51 shown is used to perform so-called blade coating, for carrying out which there are several different ways according to the prior art. Examples of these are brushing-roll, short-delay, and nozzle-applications, the implementations of which are not discussed in greater detail in this connection.

Using the coating device 51 of the type shown, the paper web 42.1, 42.2 (FIGS. 5*a*, 5*b*) is brought onto the surface of the backing roll 41. The paper web 42.1 is brought to the backing roll 41, which is supported on a fixed frame 50, from the side of the roll 41 opposite to the blade holder 45. Depending on the type of application, the coating is applied to the surface of the web 42.1 in the area beneath the roll 41 or after the bottom of the roll 41. However, application is carried out before the blade holder 45, to which the blade 43 is attached. The amount of coating remaining on the web 42.2 is regulated by the loading acting on the blade 43 (FIG. 5*a*), by means of which the excess coating is scraped off the surface of the web 42.2. From the coating device 51, the web 42.2 is taken, for example, to the following dryer (not shown).

The doctoring angle of the blade 43, which is thus attached in, for example, a manner that is as such known, to the blade holder 45 (FIG. 6*a*, 6*b*), is adjusted using the blade beam 39, shown in FIG. 1. The blade beam 39 is arranged in such a way that it can be rotated relative to its bearing point. At the ends of the blade beam 39, there are bearing points, which are arranged in rotating frames 28.1, 28.2 at both ends of the coating device 51, and which are also connected to the ends of the backing roll 41. In the upper part of the rotating frame 28.1, 28.2, there is a feed-through opening 27 extending through the frame beam. In the opening 27, there is a hollow shaft 52 (FIGS. 4*a*, 4*b*), by means of which the blade beam 39 is suspended in bearings from the rotating frame 28.1, 28.2. Connected to the blade-beam suspension, there is adjustment equipment, using which the blade angle is adjusted during running. Further, the rotating frame 28.1, 28.2 is also articulated from the joint point 38 to a fork formed by the fixed frame 37. The articulation allows the rotating frame 28.1, 28.2 to be turned, for example, between the blade-changing and washing positions.

The unused blade band 43 feed devices of the blade-changing equipment 10 according to the invention are attached in connection with the feed-through opening 27 of the hollow shaft 52 outside the second rotating frame 28.1. At the side of the coating device 51 opposite to the equipment 10, there are devices 40 correspondingly arranged outside the rotating frame 28.2, at least for reeling the used blade band 43.

Figure 2:
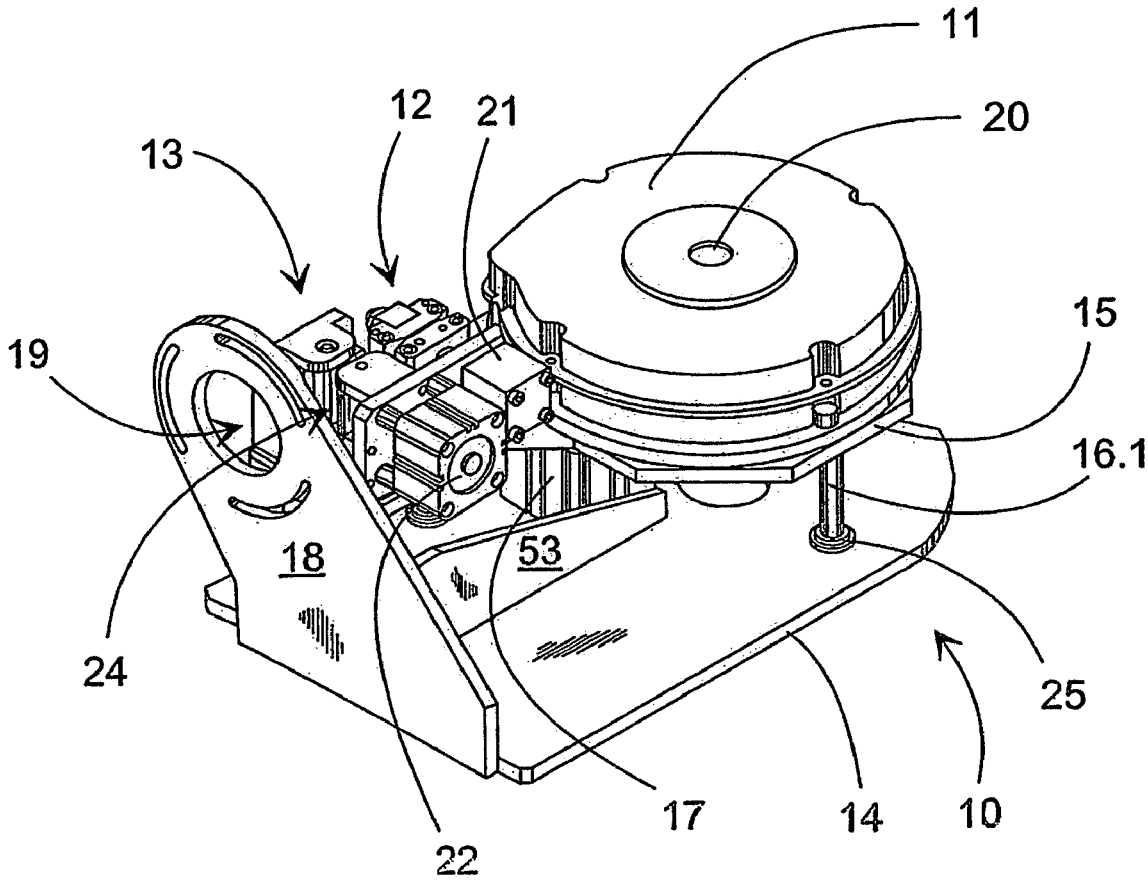
FIG. 2 is an axonometric view of the equipment according to the invention, seen from the side.
Figure 3:
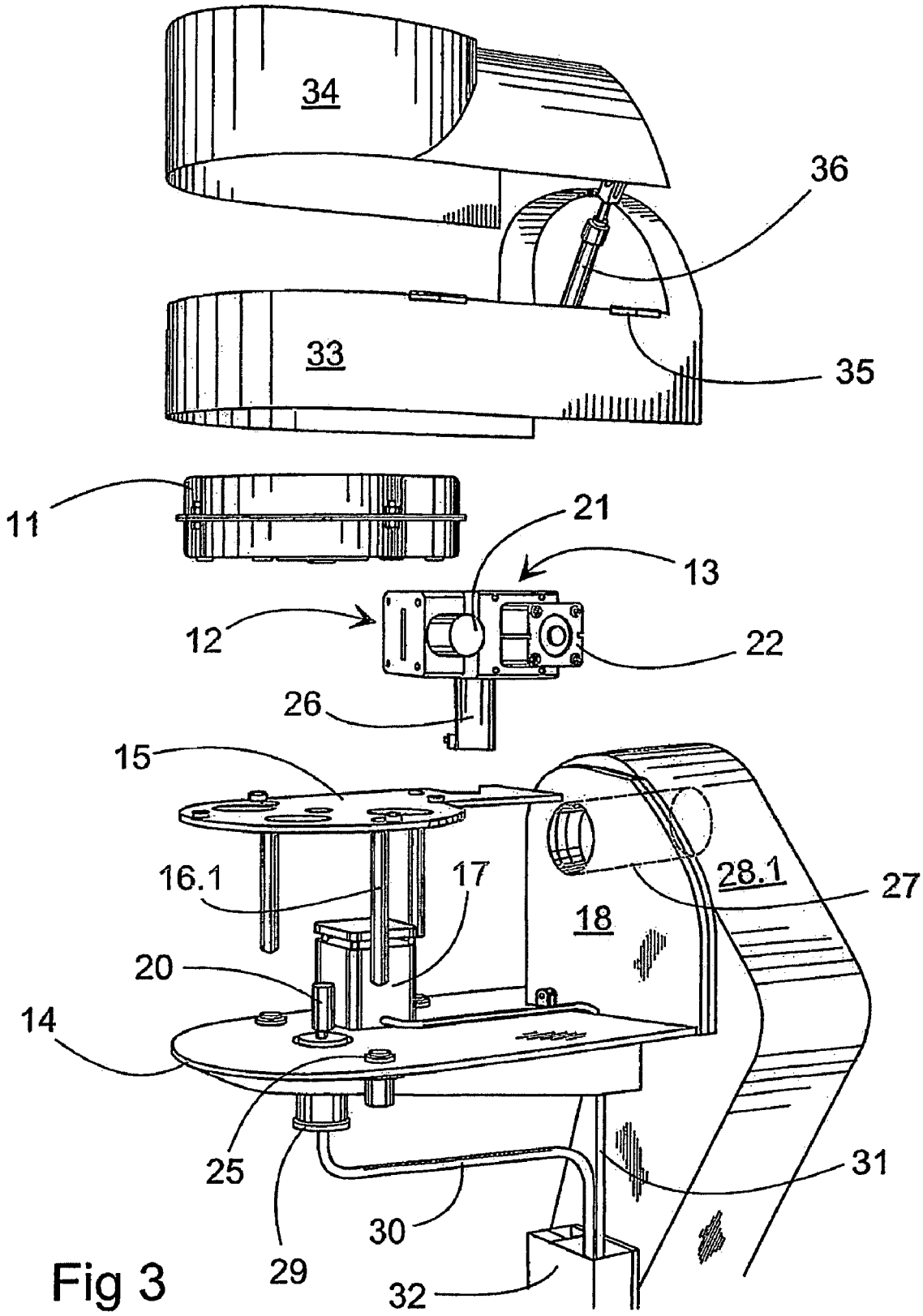
FIG. 3 is an exploded perspective view of the equipment shown in FIG. 2.

FIGS. 2 and 3 show one embodiment of equipment 10 applying the method according to the invention for changing the blade band 43. The figures show that part of the equipment 10, by means of which the unused blade band 43 is brought into the blade holder 45. The blade band 43 feed devices of the equipment 10 includes a blade box 11, in which a unified elongated flexible band 43 comprising several blades 43 is reeled on a reel. It should be noted, that the blade and blade band are referred to using a common reference number 43, as are the box and reel reference numbers 11 and 40. In the blade box 11 there is an opening, from which the band 43 is fed out.

When the blade box 11 is stationary in the equipment 10, the opening is followed by a jointing device 12 arranged preferably tangentially relative to the feed-out opening of the band 43. The jointing device 12 is used to attach the end of the blade band 43 that is ending in the box 11 to the starting end of a band on a new full reel. The joint made by the jointing device 12 is based, for example, on an end-to-end joint made by riveting or in some similar manner. The jointing device 12 is also used to create smooth blade changing when changing the boxes 11, because then too no special manual blade threading operations are needed. The joint between the ending and the starting blade band can thus be moved smoothly from the first reel 11 connected to one end of the blade holder 45 to the second reel 40 connected to the second end of the blade holder 45.

The jointing device 12, the drive device 21 of which can be pneumatically or hydraulically operated, is followed by guide devices. The guide devices include a nip 24 or similar guide, which is formed, for example, of two rollers set vertically against each other. The nip 24, the drive device 22 of which can also be pneumatically or hydraulically operated, holds the blade band 43 in a suitable position while it is being fed to the blade holder 45. Furthermore, the blade band 43 is also moved forward by the aid of the nip 24. The location of the nip 24 in the equipment 10 must be aligned quite precisely relative to the blade holder 45, because the nip 24 is used to guide the lowering of the blade band 43 to the narrow opening of the blade holder 45, as will later be described in the description. The pneumatic or hydraulic lines of the drive device 21, 22 of the jointing device 12 and the guide devices 13 are not shown in the figures.

The equipment 10 is bounded underneath by a lower frame 14. Above the lower frame 14 is an upper frame 15 at the locations of the blade box 11, the guide devices 13, and the jointing devices 12, on top of which the blade box 11 and the guide and jointing devices 13, 12 are attached. In the upper frame 15 and the blade box 11 there can be members (for example, protrusions and openings) fitted into each other, to firm and stable attachment of the blade box 11 to the upper frame 15 (not shown). Also, the jointing device 12 and the guide devices can also form a single totality, which has a foot 26 fitted to the upper frame 15.

Further, between the lower frame 14 and the upper frame 15 there are lifting devices, such as a lifting cylinder 17. The lifting cylinder 17, which is, for example, pneumatically or hydraulically operated with line 31, is attached to the lower frame 14. The lifting cylinder 17 is used to lift and lower the blade band 43 when it is changed in the coating device 51. In connection with blade changing, the blade box 11, jointing devices 12, and guide devices 13, arranged on top of the upper frame 15, also rise and fall.

Between the lower frame 14 and the upper frame 15 there are also guides, such as vertical bar elements 16.1. The bar elements 16.1, of which there are three in the device 10 according to the embodiment, are fixed in connection with the upper frame 15. In the lower frame 14, there are holes 25 for the guides 16.1, in which Holes the guides can be moved by the lifting cylinder 17 when lifting or lowering the components 11, 12, 13 in the upper frame 15.

In the lower frame 14, there is also a vertically oriented shaft 20 (FIG. 3) at the blade box 11. The shaft 20 can be fitted inside the blade-band reel 11, in such a way that it fits into, for example, the hub (not shown) arranged at the center of the band reel. Together with the pneumatic or hydraulic motor 29 connected to it, the shaft 20 forms transfer means, using which the blade band 43 is moved out of the reel 11. The motor 29 is beneath the lower frame 14 and an encased 32 line 30 to it to provide drive power.

A flange 18, in the upper part of which there is an opening 19 (FIG. 2), is also attached to the lower frame 14. The flange 18 allows the equipment 10 to be suspended from the rotating frame 28.1 of the coating device 51, in such a way that the equipment 10 is attached to the hollow shaft 52, which forms a suspension with bearings, through the feed-through openings 27 of the rotating frame 28.1. Thus, when the blade beam 39 between the frame beams 28.1, 28.2 is rotated, the equipment 10 also turns correspondingly outside the frame beam 28.1. In connection with the flange 18, there may also be reinforcements 53 (FIG. 2), for reinforcing the rigidity of the equipment 10.

A cased blade-band reeling equipment 40 (FIG. 1) for used blade band is also arranged on the side of the coating device 51 opposite to the unused band 43 feed equipment 10. It is also suspended and mounted in bearings connected to the rotating frame 28.2, using a similar principle. The equipment 40 can include a minimum of only a reel equipped with transfer means, for reeling the used band and lifting devices for lifting and lowering the reel and also the blade band, in connection with blade changing. In addition, the equipment 40 can include, for example, corresponding guiding devices to those described in connection with the equipment 10. The equipment 40 can, in addition, include device for cutting the blade band, when changing an empty reel.

As can be seen in FIG. 3, the equipment 10 can be encased. The casing is formed of a wall component 33 enclosing the components 11, 12, 13, and a cover component 34 that lies on top of it. An operating device 36 is attached between the cover and wall components, for turning the cover component 34 between the open and closed positions. The wall component 33 can also include means 35 for locking the cover component 34 during the operation of the equipment 10.

Figure 4A:
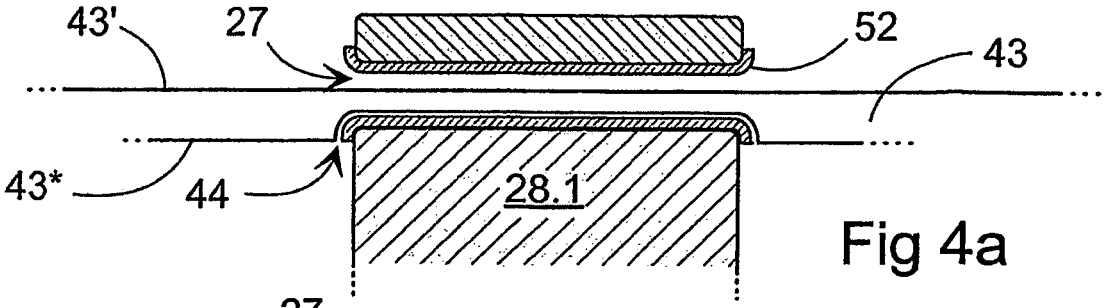
FIG. 4*a* is a cross-sectional view of the rotating frame of the coating device in the running situation.
Figure 4B:
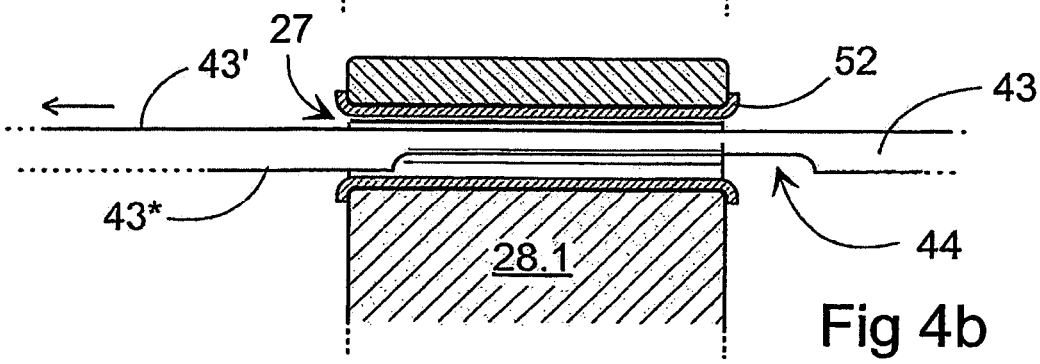
FIG. 4*b* is a cross-sectional view of the rotating frame of the coating device in the blade-changing situation.

FIGS. 4*a* and 4*b* show a cross-section of the upper part of the rotating frame 28.1, 28.2. In the frame 28.1, 28.2, there is thus a through opening 27 in its upper part, which acts as a suspension point for the blade beam 39. In the through opening 27, there is a hollow shaft 52, by means of which the blade beam 39 and the equipment 10, 40 according to the invention suspended on the opposite side of the rotating frame 28.1, 28.2 to it, are mounted in bearings connected to the frame 28.1, 28.2.

Figure 5A:
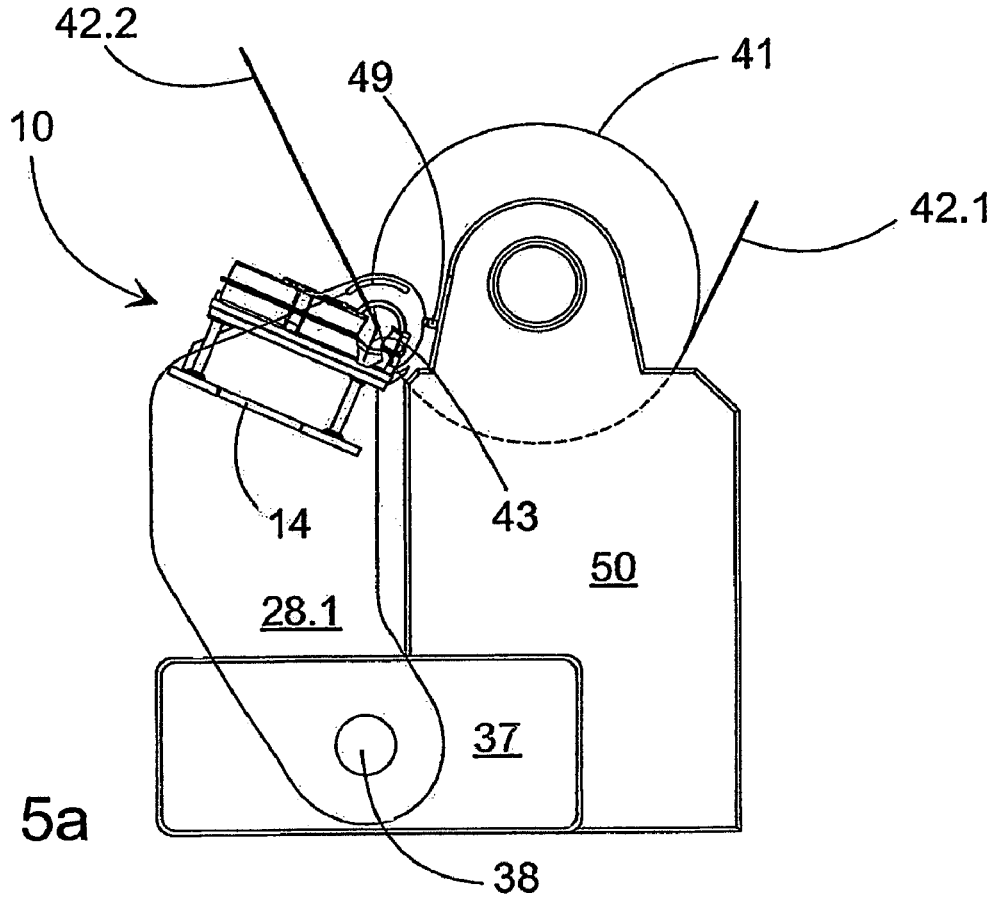
FIG. 5*a* is a partial cross-sectional side view of the coating device in the running position, seen from the side of the installation of the equipment according to the invention.

FIG. 5*a* shows a side view of the coating device 51 in the running position. In that case, the rotating frame 28.1 is turned close to the backing roll 41. The rotation of the frame 28.1 is limited by a constant-angle device 49 in a fixed frame 50, against which the upper part of the rotating frame 28.1 rests. In the running position, the edge line 43' of the blade 43 (FIG. 5*a*) lies on the imaginary center-line of the hollow shaft 52 and the through opening 27 of the rotating frame 28.1. The blade angle is adjusted by rotating the blade beam 39, for which purpose special adjustment devices (not shown) are arranged, for example, in connection with the blade-beam suspension 27, 52. When the blade angle is adjusted, corresponding rotation also occurs in the feed equipment 10 of the unused blade band 43 suspended on bearings on the hollow shaft 52 arranged on opposite side of the rotating frame 28.1 and the reeling devices 40 of the used blade band 43 arranged on the other side of the coating device 51.

FIGS. 4*a* and 4*b* show one embodiment of the blade band 43 according to the invention, which is used in the equipment 10, 40 according to the invention and which for its part permits the blade band 43 of the method according to the invention to be changed on the coating device 51. There are indentations 44 made at regular intervals on the opposite side of the blade band 43 to the edge line 43' , with which the coating is doctored from the surface of the web 43.1. The distance between the indentations 44 preferably corresponds to the distance between the rotating frames 28.1, 28.2. In the indentations 44, there is a curved rise to the level of the side 43* of the holder 45 of the blade band 43, which prevents the band 43 from tearing. The length of the indentations 44 is dimensioned so that it corresponds at least to the axial length of the hollow shaft 52. The depth of the indentations 44 is dimensioned so that when the indentation 44 lies against the internal circumference of the hollow shaft 52, the side opposite to the edge line 43' of the blade 43 is in the bottom of the gap between the jaws 46.1, 46.2 of the blade holder 45. The holder side 43* of the blade band 43 is then, in the radial direction, partly outside the imagined continuation of the hollow shaft 52. Correspondingly, the edge line 43' of the blade 43 is then at the center line of the hollow shaft 52.

Figure 6A:
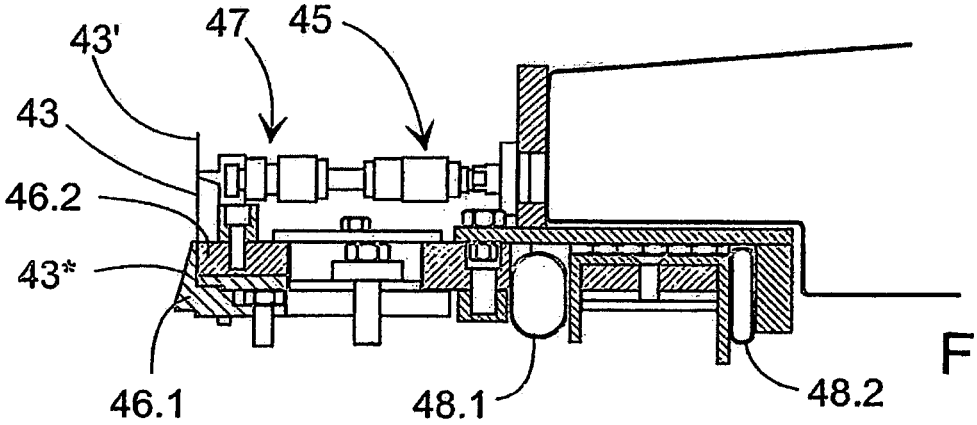
FIG. 6*a* shows one blade holder in the running position.
Figure 6B:
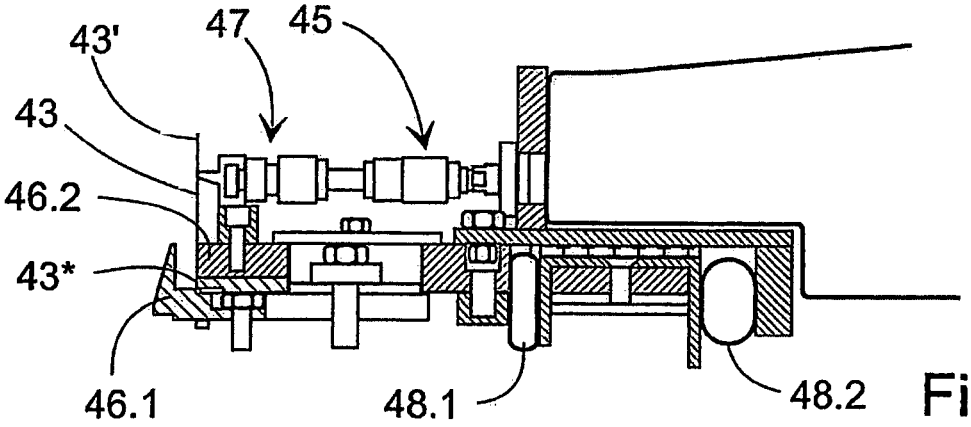
FIG. 6*b* shows one blade holder in the blade-changing position.

FIG. 6*a* shows the blade holder 45 in the running position, and FIG. 6*b* in the blade-changing position. When using the equipment 10, 40, the method and the blade band 43 according to the invention, the blade holder 45 may be of a type that is, as such, known, one example of which is shown in FIGS. 6*a* and 6*b*. The blade band 43 is between the fixed jaw 46.1 and the moving jaw 46.2 of the blade holder 45. Relative to the edge line 43' of the blade band 43, the opposite side 43* is in the bottom of the gap formed by the jaws 46.1, 46.2. The blade 43 can be used to perform local profiling of the amount of coating, which is done by loading the blade 43 using spindles 47. The profiling spindles 47 can be at, for example, intervals of 75/150 mm. The spindles 47 are equipped with operating devices to load them.

The opening and closing to the jaws 46.1, 46.2 of the blade holder 45 is done in a manner that is, as such, known, for example, by loading the hoses 48.1, 48.2. If the gap formed by the jaws 46.1, 46.2 is kept closed, hose 48.1 is loaded and hose 48.2 is not loaded, or at least is loaded substantially less than hose 48.1.

The following is a description of the method according to the invention, for changing the blade 43, using the equipment 10, 40, with reference to FIGS. 4-6. The control of the equipment 10, 40 can be preferably linked to the machine-control automation, in which case the blade change can be performed even entirely automatically. Once the set blade-change criterion condition has been met, a blade change takes place on the coating device 51. Such a condition can be, for example, the wear of the blade 43, or in general the interval of time, based on experiential data, which has passed since the previous blade change. Changing can also be carried out in association with web-breaks or washing.

The paper web 42.1, 42.2 being run through the coating device 51 can be taken down before the coating device 51 and led to a pulper or similar. On the other hand, the web 42.1, 42.2 can also be run through the coating device 51 at the time of the blade change too, in which case uncoated broke will be created. Such a through run has, however, the advantages that in such a case tail-threading need not be carried out after the blade change, in order to take up the web 42.1, 42.2 again.

Figure 5B:
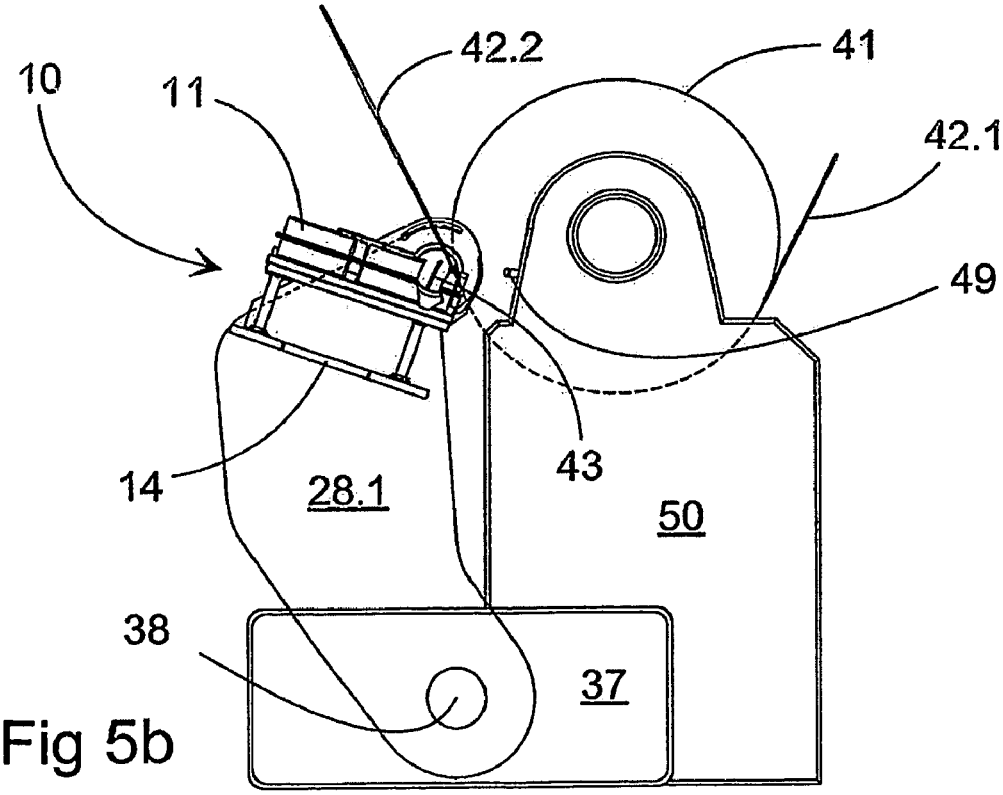
FIG. 5*b* is a partial cross-sectional side view of the coating device in the blade-changing position, seen from the side of the installation of the equipment according to the invention.

The blade change is started by ending the application of coating and turning the blade beam 39 and the rotating frame 28.1, 28.2 from the position shown in FIG. 5*a* to the blade-changing position, which is shown in FIG. 5*b*. The blade 43 then detaches from the backing roll 41, or possibly from the paper web 42.1, 42.2 running on its surface.

Next, the jaws 46.1, 46.2 of the blade holder 45, which have been in the running position shown in FIG. 6*a*, are opened. Opening take place in a manner that is, as such, known, by altering the pressure in the loading hoses 48.1, 48.2. The upper part of the sliding line of the holder 45 then slides to the right, while the lower part remains stationary. In FIG. 6*b*, the blade holder 45 is shown in the blade-changing position. The opening between the jaws 46.1, 46.2 is shown exaggeratedly large for reasons of clarity. In reality, even a small opening (for example, 3 mm) is sufficient to carry out blade changing.

After the opening of the blade holder 45, the blade band 43 is in the hollow shaft 52 in the running position, which is shown in FIG. 4*a*. The indentation 44 arranged in the blade band 43 is then against the internal circumference of the hollow shaft 52 and the edge line 43' of the blade band 43 is on the level of the central-axis of the hollow shaft. According to the invention, the blade band 43 is lifted out of the blade holder 45. Lifting takes place using the lifting devices of the equipment 10, 40. i.e. in this case using the lifting cylinder 17. The lifting cylinder 17 lifts the upper frame 15 of the equipment 10 and at the same time also the blade box 11 and the jointing and control devices 12, 13 installed on top of the upper frame 15. As a result of lifting, the blade band 43 also rises, so that the indentation 44 arranged in it lifts off the internal circumference of the hollow shaft 52 and the side 43* of band 43 next to the blade holder 45 rises to inside the imaged continuation of the hollow shaft 52.

Next, the blade band 43 is moved transversely relatively to the coating device 51 (the arrow in FIG. 4*b*). Then the next unused band area fed from the blade box 11, which thus forms the new blade 43, moves to the doctoring area corresponding to the backing roll 41, in connection with the blade holder 45. Prior to moving, the indentation 44 of the blade band 43 that was associated with the frame 28.1 on the unused blade band 43 side, now moves to be associated with the frame 28.2 on the used blade band 43 side, on the opposite side of the coating device 51. The used blade of the blade band 43 is reeled using the devices 40 in connected with the frame 28.2.

Once the indentations 44 have been brought to positions corresponding to the frame 28.1, 28.2, the blade band 43 is lowered using the lifting devices 17 belonging to the equipment 10, 40. The indentation 44 of the blade band 43 then once again settles onto the internal circumference of the hollow shaft 52 (FIG. 4*a*) and edge line 43' of the blade band 43 to the center line of the hollow shaft 52.

Once the blade band 43 has been lowered to its lower position, it is guided between the jaws 46.1, 46.2 of the blade holder 45. It should be noted, that the blade band 43 does not, during the transfer, necessarily need to be lifted entirely out of the holder 45, instead the lifting required is determined rather by the depth of the gap formed between the indentation 44 and the jaws 46.1, 46.2 of the blade holder 45. The jaws 46.1, 46.2 of the blade holder 45 are closed (FIG. 6*a*) and the blade beam 39 and the rotating frame 28.1, 28.2 are turned back to the running position, the situation corresponding to which thus being shown in FIG. 5*a*.

Preferably, the first reel 11 is located on the front side and the second reel 40 on the back side. It is therefore easy to bring a reel 11 containing a new band 43 to the equipment 10. The used band can be removed from the back side, by changing the filled reel 40. The location and changing of the reels 11, 40 are made to suit each operating situation. In FIG. 1, the front side is on the right and the back side on the left. The equipment according to the invention is highly suitable from different kinds of coating devices, for coating in both paper and in board, and also for different kinds of blades and blade holders. The equipment can also be easily retrofitted, though the most suitable positions can be selected for the reels in connection with the design of a new device. The equipment is light and safe to use. In addition to operation connected to the machine-maintenance automation, remote control operation from next to the coating device 51 itself is also possible. Other essential features are the smooth transfer of the band and the small stresses imposed on the band. Respectively, the method according to the invention speeds up considerably the blade change.

It must be understood that the above description and the related figures are only intended to illustrate the equipment, method, and blade band according to the present invention. For example, the blade change can include numerous other stages that are not referred to, which are, however fairly irrelevant when describing the method according to the invention. The invention is thus in no way restricted to only the embodiments disclosed or stated in the Claims, but many different variations and adaptations of the invention, which are possible within the scope of the inventive idea will be obvious to one versed in the art.

The invention claimed is:

1. A method for changing a blade in a coating device, in which method a single elongated flexible band, formed of multiple blades to be used in connection with coating, is used, the method comprising the steps of:

opening a blade holder arranged in connection with a blade beam;

lifting a used blade from the blade holder;

removing the used blade from contact with the blade holder;

bringing an unused blade through a hollow shaft having a length, into contact with the blade holder, wherein the unused blade is brought through the hollow shaft simultaneously with removing the used blade through an opposite hollow shaft;

lowering said unused band into the blade holder in such a way that it settles partly outside of an imagined continuation of the hollow shaft;

closing the blade holder, wherein the multiple blades are arranged as a long reeled band, in which band indentations at least the length of the hollow shaft are arranged at regular intervals on a blade holder side of the band, said indentations being positioned, and the unused blade lowered, such that said indentations permit the blade to be lowered into the blade holder and settle partly outside of the imagined continuation of the hollow shaft; and;

loading the blade against a paper or board web on a backing roll, and doctoring coating paste on the paper or board web with the blade to regulate the amount of coating paste remaining on the paper or board web and to smooth coating paste on the paper or board web.

2. The method of claim 1 wherein when the blade beam is turned, the reels are turned.

3. The method of claim 1 wherein the band is guided at least when being brought in connection with the blade holder.

4. Equipment for changing a coating blade in a coating device comprising:

a blade holder fitted to a blade beam, wherein the coating blade has a coating application edge and is formed as an elongated flexible band, and wherein the coating device has a blade beam suspension arranged in connection with a frame at the ends of the blade beam, and wherein the blade is arranged in a hollow shaft having a central axis and which is fitted to the frame, in such a way that, in a running position, the central axis of the hollow shaft is arranged to lie essentially on the coating application edge of the blade, and control equipment, arranged in connection with the blade-beam suspension, for adjusting the blade angle during running, wherein the band comprises a plurality of blades;

a first reel connected to a first end of the blade holder for holding reeled unused band;

a second reel connected to a second end of the blade holder for holding reeled used band;

transfer devices for moving the band between the first reel and the second reel in connection with the blade holder;

guide devices for bringing the band from the first reel through the hollow shaft into the blade holder and out of the blade holder through a hollow shaft to the second reel, and lifting devices for lifting the band up from the blade holder and lowering the band into the blade holder; and portions of the band which define indentations at least the length of the hollow shaft arranged at regular intervals on a blade holder side of the band, the indentations being arranged to permit the blade to be towered into the blade holder in which the blade holder side of the blade is arranged to settle outside of an imagined continuation of the hollow shaft.

5. The equipment of claim 4 wherein the hollow shaft, is arranged to turn relative to the frame, when the blade beam is turned.

6. The equipment of claim 4 wherein the guide devices comprise nip devices.

7. The equipment of claim 4 further comprising devices in connection with the blade holder for joining bands to each other.

8. The equipment of claim 4 wherein the lifting devices are arranged to also lift the reels and/or the guide devices.

9. The equipment of claim 7 wherein the lifting devices are arranged to also lift the devices for joining bands to each other.

* * * * *